US008714902B2

(12) United States Patent
Jones et al.

(10) Patent No.: US 8,714,902 B2
(45) Date of Patent: May 6, 2014

(54) SYSTEM AND METHOD FOR UNWRAPPING ROUND MODULES

(75) Inventors: Malcom Lee Jones, Amarillo, TX (US); Larren Michael Jones, Nazareth, TX (US)

(73) Assignee: Jones Practical Innovations, LLC, Hereford, TX (US)

( * ) Notice: Subject to any disclaimer, the term of this patent is extended or adjusted under 35 U.S.C. 154(b) by 520 days.

(21) Appl. No.: 12/846,045

(22) Filed: Jul. 29, 2010

(65) Prior Publication Data

US 2011/0197552 A1 Aug. 18, 2011

Related U.S. Application Data

(60) Provisional application No. 61/337,964, filed on Feb. 12, 2010.

(51) Int. Cl.
*B65G 65/00* (2006.01)

(52) U.S. Cl.
USPC ..... 414/412; 414/911

(58) Field of Classification Search
USPC ..... 414/412, 24.5, 24.6, 25, 411, 416.07, 414/677, 910, 911; 53/492, 381.2; 83/733, 83/865, 870, 871, 872, 874, 78, 102, 75, 83/284, 319, 318, 409, 409.1, 401, 425, 83/435.12; 19/0.35, 0.6, 0.58; 198/456, 198/578, 587; 493/309, 199
See application file for complete search history.

(56) References Cited

U.S. PATENT DOCUMENTS 2,729,885 A * 1/1956 Wahl et al. ..... 30/2
2,982,075 A * 5/1961 Foster ..... 53/381.2
3,330,401 A * 7/1967 Ahlstedt ..... 198/463.5
3,620,887 A * 11/1971 Nelson et al. ..... 156/563
3,889,442 A * 6/1975 Grahn et al. ..... 53/492
4,344,268 A * 8/1982 Wakamatsu et al. ..... 53/381.2
4,794,671 A 1/1989 Goldman
4,929,141 A * 5/1990 Keesey et al. ..... 414/412
5,018,924 A * 5/1991 Palmer ..... 414/24.5
5,129,462 A * 7/1992 Mail ..... 172/19
5,199,841 A * 4/1993 Von Gehlen ..... 414/412
5,228,628 A * 7/1993 Temburg et al. ..... 241/101.4
5,318,399 A * 6/1994 Marom ..... 414/412
5,359,753 A * 11/1994 Leifeld et al. ..... 19/97.5
5,454,683 A 10/1995 Marom et al.
5,463,841 A 11/1995 Hayakawa et al.
5,505,406 A * 4/1996 Summey, III ..... 242/563.1
5,676,513 A * 10/1997 Bingham ..... 414/24.5
6,068,434 A * 5/2000 Vankooten ..... 414/24.5
6,171,047 B1 * 1/2001 Vandervalk ..... 414/24.5
6,332,426 B1 12/2001 van den Berg
6,764,274 B2 * 7/2004 Maclay ..... 414/812
7,165,928 B2 * 1/2007 Haverdink et al. ..... 414/412
(Continued)

FOREIGN PATENT DOCUMENTS

WO 9628352 A1 9/1996

*Primary Examiner* — Saul Rodriguez
*Assistant Examiner* — Glenn Myers
(74) *Attorney, Agent, or Firm* — Shannon L Warren

(57) ABSTRACT

A system and method for unwrapping round modules is disclosed. Specifically, a method for unwrapping a round module is disclosed. The method comprises supporting a round module wrapped in a module wrapper on a tilting module feeder having a tilting module feeder first side and a tilting module feeder second side, cutting the module wrapper substantially horizontally from a round module first side to a round module second side, and applying tension to a module wrapper top flap.

13 Claims, 9 Drawing Sheets

(56) References Cited

U.S. PATENT DOCUMENTS

| | | | |
|---|---|---|---|
| 2003/0019345 | A1 | 1/2003 | Platon |
| 2006/0191241 | A1 | 8/2006 | Deutsch |
| 2007/0181469 | A1 | 8/2007 | Stover |
| 2009/0108606 | A1 | 4/2009 | Noonan |
| 2009/0202327 | A1 | 8/2009 | Cory et al. |
| 2009/0205932 | A1 | 8/2009 | Stover |
| 2009/0238667 | A1 * | 9/2009 | Curles ..... 414/412 |
| 2009/0297325 | A1 | 12/2009 | Daraie |

* cited by examiner

SYSTEM AND METHOD FOR UNWRAPPING ROUND MODULES

BACKGROUND

This disclosure relates to a system and method for unwrapping round modules. For purposes of this disclosure, cotton modules are discussed, and are an example of a fibrous material. However, such discussion of cotton modules is solely exemplary, and not limiting.

Methods for handling harvested cotton by cotton harvesters, such as cotton strippers or cotton pickers, have evolved over the years. At one time, cotton would be dumped into trailers that were then delivered to the cotton gin. This system required frequent trips to the cotton gin, expending significant amounts of time and energy. Eventually, cotton strippers were developed capable of forming the cotton into rectangular cotton modules. Rectangular cotton modules eliminated the need for frequent trips to the cotton gin because modules were capable of accumulation without trailers. However, rectangular cotton modules were susceptible to damage due to environmental hazards such as moisture and wind erosion. To protect rectangular cotton modules awaiting delivery to a cotton gin, a plastic tarpaulin cover was frequently employed. Such methods of handling harvested cotton in covered rectangular cotton modules have been further improved by the introduction of cotton harvesters capable of making round modules of harvested cotton.

Round modules can be cylindrical packed cotton modules wrapped in tarpaulin covers along the side walls of the cylinder shape. They can be created of harvested cotton inside modern cotton harvesters. More comprehensively wrapped than their predecessors, round modules overcome many of the shortcomings of covered rectangular cotton modules. The round module can provide substantial savings by preventing lost or damaged cotton due to environmental deterioration. For example, round modules are less likely to absorb ground water which could foreseeably collect around the base of a cotton module.

Round modules represent a technological advancement in the handling of harvested cotton but cause new difficulty for cotton gins. Gin operators must completely separate cotton from the round module wrapper such that no contaminants from the wrapper remain during ginning.

Various methods exist for separating cotton from the round module wrapper. In one embodiment, a pair of curved arms lifts the round module and rotates the module along its cylindrical axis. A slitter for cutting the cover removes the cover during rotation. However, such system is incapable of accommodating multiple round modules simultaneously and fails to provide a uniform feed of unwrapped cotton exiting the system. In another embodiment, arm structures grasp, lift and reorient the round module into a vertical orientation, thereby allowing the weight of the cotton itself to pull the cotton out of the open bottom of the module. As the cotton drops from the module wrapper, the wrapper is retained by spikes in the grasping arm structures. Likewise, such system is also incapable of accommodating multiple round modules simultaneously and fails to produce a uniform feed of unwrapped cotton exiting the system. Further, this embodiment is likely to leave cotton bound within the uncut module wrapper.

As such it would be useful to have an improved system and method for unwrapping round modules.

SUMMARY

A method for unwrapping a round module is disclosed. The method comprises supporting a round module wrapped in a module wrapper on a tilting module feeder having a tilting module feeder first side and a tilting module feeder second side, cutting the module wrapper substantially horizontally from a round module first side to a round module second side, and applying tension to a module wrapper top flap.

Further, a system for removing module wrappers is disclosed. Specifically, a round module unwrapping system is disclosed, having a tilting module feeder, the tilting module feeder having a first side and a second side. The tilting module feeder supports a round module wrapped in a module wrapper. The round module unwrapping system also comprises a cutter that cuts the module wrapper substantially horizontally from a round module first side to a round module second side. The round module unwrapping system also comprises a line that applies tension to module wrapper top flap.

DETAILED DESCRIPTION

Described herein is a system and method for unwrapping round modules. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
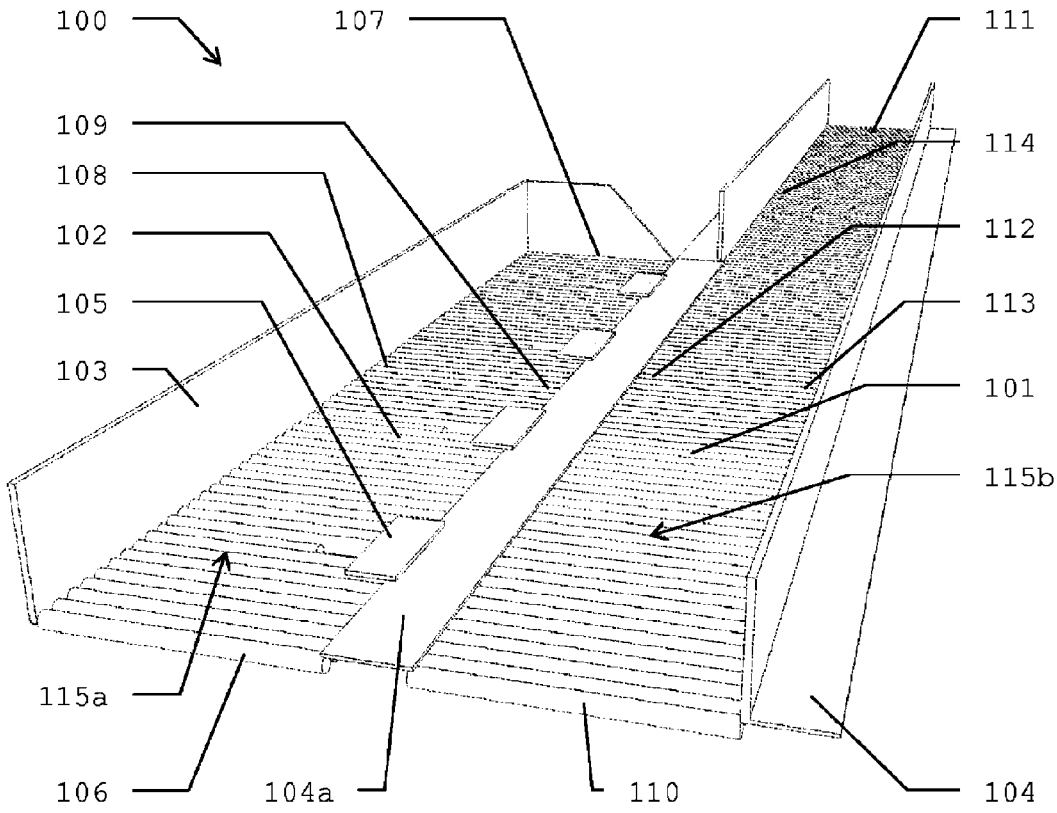
FIG. 1 illustrates a round module unwrapping system.

FIG. 1 illustrates a round module unwrapping system 100. Module unwrapping system 100 can comprise a primary module feeder 101, a titling module feeder 102, one or more wind boards 103, one or more module unwrapper catwalks 104, and/or one or more module paddles 105. Titling module feeder 102 can comprise a titling module feeder first end 106, a titling module feeder second end 107, a titling module feeder first side 108, and a titling module feeder second side 109. Primary module feeder 101 can comprise a primary module feeder first end 110, a primary module feeder second end 111, a primary module feeder first side 112, and a primary module feeder second side 113. In one embodiment, primary module feeder 101 can be longer than titling module feeder 102. In such embodiment, primary module feeder 101 can comprise a primary module feeder second end first side 114 along the edge of primary module feeder first side 112 extending beyond titling module feeder second side 109.

Tilting module feeder 102 can comprise a tilting module feeder floor 115*a*. Primary module feeder 101 can comprise a primary module feeder floor 115*b*. Tilting module feeder floor 115*a* and primary module feeder floor 115*b* can each comprise a roller-bed, a gravity skatewheel conveyor, a gravity roller conveyor, a belt conveyor, a wire mesh conveyor, a plastic belt conveyor, a belt driven live roller, a lineshaft roller conveyor, a chain conveyor, a screw conveyor, a chain driven live roller conveyor, or the equivalent thereof.

Round module unwrapping system 100 can include one or more titling module feeders 102. In one embodiment, titling module feeder 102 is aligned next to primary module feeder first side 112. In another embodiment, titling module feeder 102 is aligned next to primary module feeder second side 113. In another embodiment, a first titling module feeder 102*a* is aligned next to primary module feeder first side 112 and a second titling module feeder 102*b* is aligned next to primary module feeder second side 113.

An intermediate module unwrapper catwalk 104*a* can be aligned between and abutting both primary module feeder 101 and titling module feeder 102. In one embodiment, intermediate module unwrapper catwalk 104*a* abuts primary module feeder first side 112 and titling module feeder second side 109. In another embodiment, intermediate module unwrapper catwalk 104*a* abuts primary module feeder second side 113 and titling module feeder first side 108.

Module unwrapper removal system 100 can comprise both wind boards 103 and module unwrapper catwalks 104 along the exterior edges of module unwrapper removal system 100. Wind boards 103 can block wind and create a retaining wall around module unwrapping system 100. Module unwrapper catwalks 104 can allow human access to module unwrapper removal system 100 by providing a flat surface for walking. In one embodiment in which titling module feeder 102 is aligned on primary module feeder first side 112, wind boards 103 and module unwrapper catwalk 104 can be attached at titling module feeder second end 107, titling module feeder first side 108, primary module feeder second side 113, and primary module feeder second end first side 114.

Titling module feeder 102 can comprise module paddles 105. In one embodiment, intermediate module unwrapper catwalk 104*a* abuts titling module feeder second side 109. In such embodiment, module paddles 105 can be aligned on titling module feeder second side 109. Module paddles 105 can be set to lay nearly flush with the tilting module feeder floor 115*a*.

Figure 2:
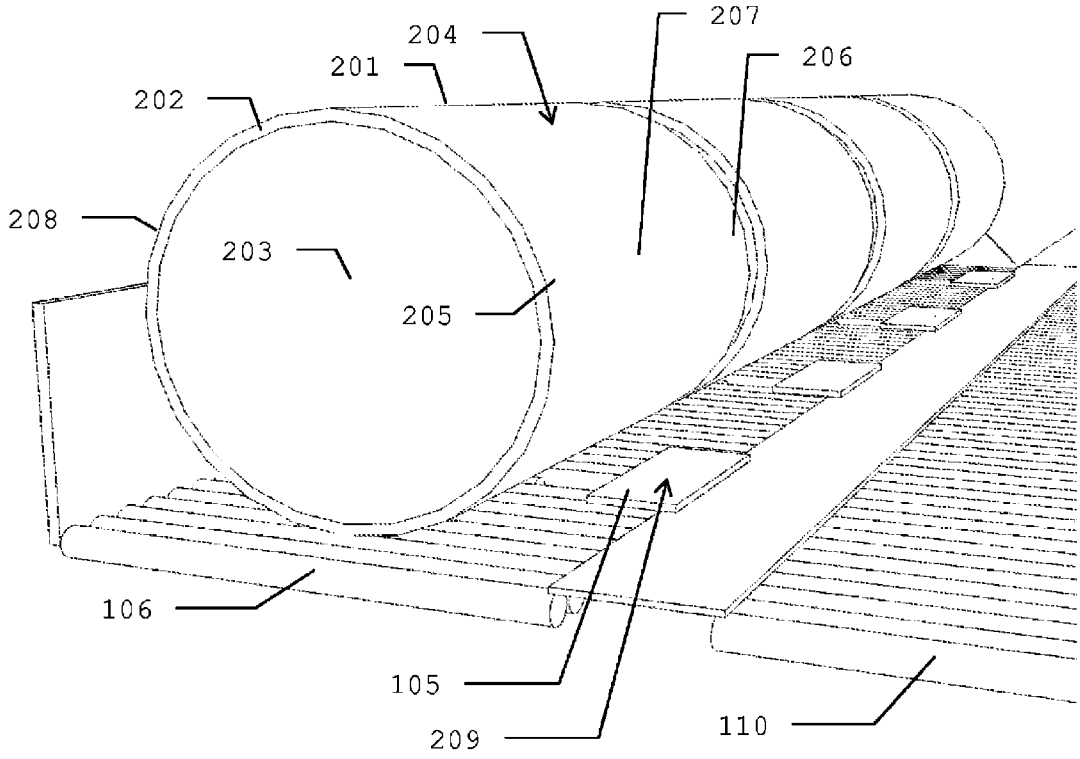
FIG. 2 illustrates a plurality of round modules loaded onto titling module feeder.

FIG. 2 illustrates a plurality of round modules 201 loaded onto titling module feeder 102. Round module 201 can comprise a module wrapper 202 substantially encasing a packed fibrous material 203 along a round module sidewall 204. Further, round module 201 can comprise a round module first side 205, a round module second side 206, a round module front 207, and a round module back 208. Packed fibrous material 203 can comprise cotton. Module wrapper 202 can comprise a tarpaulin material wrapped one or more times around packed fibrous material 203 and bound such that round module 201 does not unravel prior to processing at module unwrapper removal system 100.

Titling module feeder 102 can comprise one or more module paddles 105. Module paddles 105 can pivot up to buttress round module front 207. A module paddle 105 can comprise a module paddle surface 209 large enough to buttress one or more round modules 201. In one embodiment, module paddles 105 can be spaced where each round module 201 has a module paddle 105 aligned proximate with the bottom center of round module front 207. In another embodiment, module paddle surface 209 is wide enough to buttress multiple round modules 201 such that a plurality of round modules 201 can be buttressed by one module paddle 105.

Round modules 201 can be delivered to module unwrapper removal system 100 on a vehicle. Once delivered, round modules 201 can be loaded onto module unwrapper removal system 100 at titling module feeder first end 106. Modules of fibrous materials which are not bound as round modules 201, such as rectangular cotton modules, can be loaded onto module unwrapper removal system 100 at primary module feeder first end 110.

Figure 3:
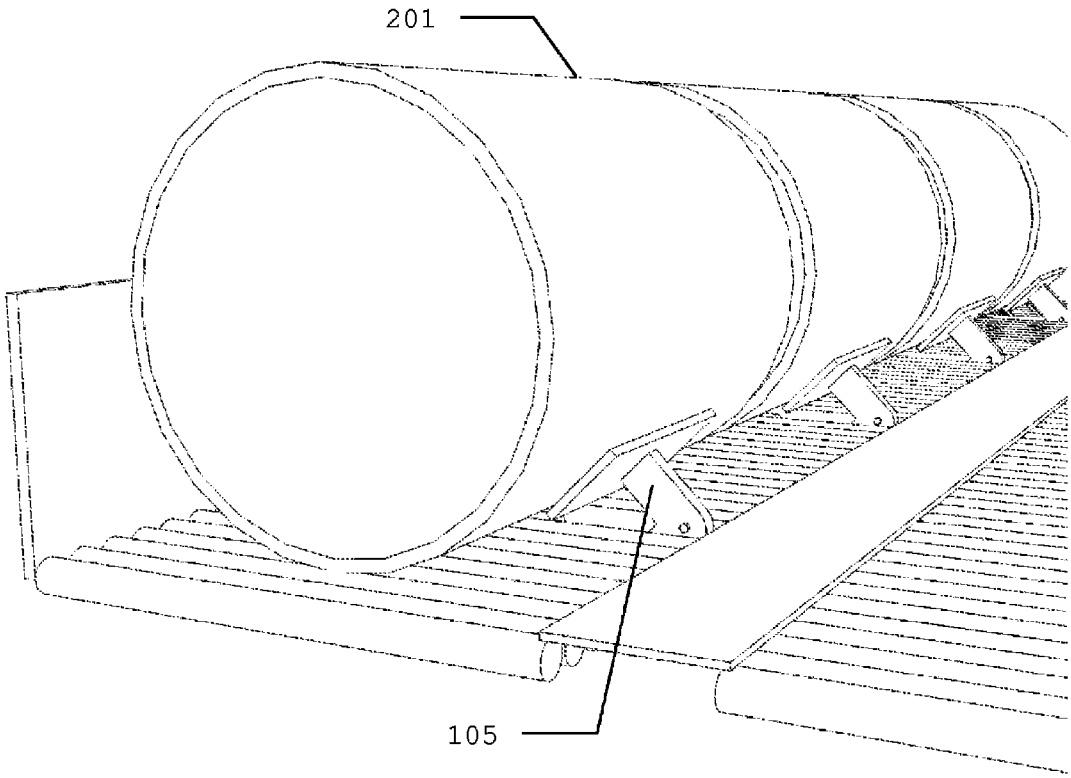
FIG. 3 illustrates module paddles pivoted up buttressing a plurality of round modules.

FIG. 3 illustrates module paddles 105 pivoted up buttressing a plurality of round modules 201.

Figure 4:
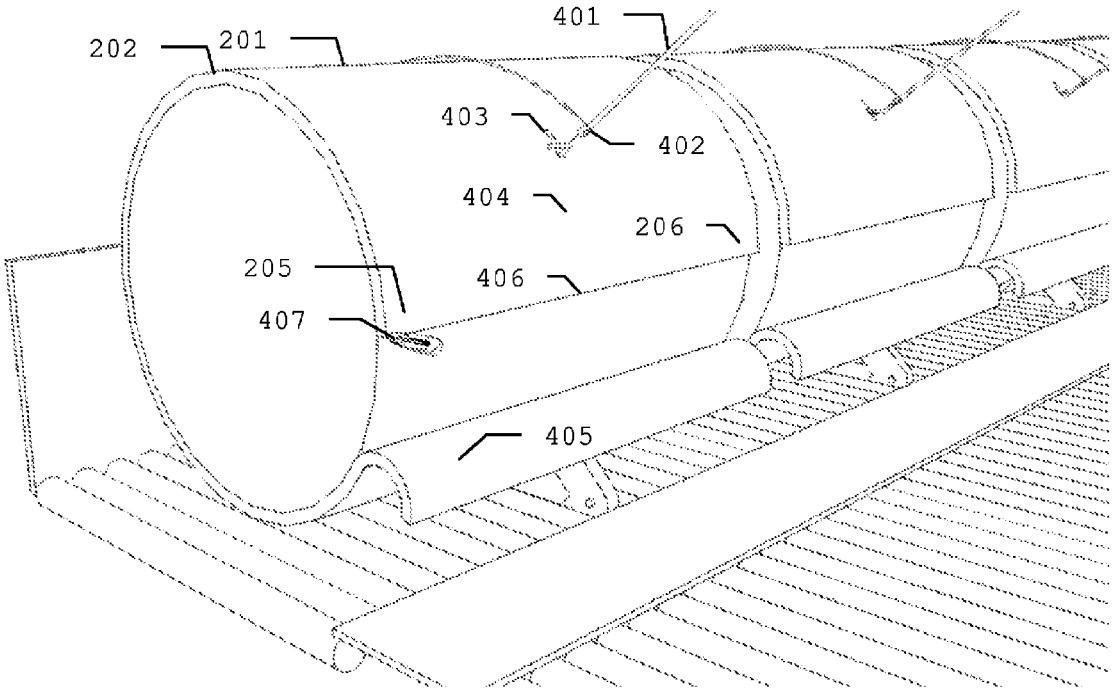
FIG. 4 illustrates round module with a substantially horizontal cut in module wrapper and a first module hook with a line.

FIG. 4 illustrates round module 201 with a substantially horizontal cut in module wrapper 202 and a first module hook 402 with a line 401. A first module hook cut 403 can be created by scoring round module sidewall 204 substantially in the upper central surface of round module front 207 with a cutter 407. "Scoring" is the act of cutting a notch or incision into the surface of something. First module hook 402 can be inserted into module wrapper 202 through first module hook cut 403. Line 401 can be attached to first module hook 402. Line 401 can be a cable, chain, rope, wire, cord, or any equivalent thereof.

A module wrapper top flap 404, a module wrapper bottom flap 405, and a module flap cut 406 can be created by cutting module wrapper 202 from round module first side 205 to round module second side 206 with the cutter 407. In one embodiment, module flap cut 406 can be located vertically between module paddle 105 and first module hook cut 403.

Figure 5:
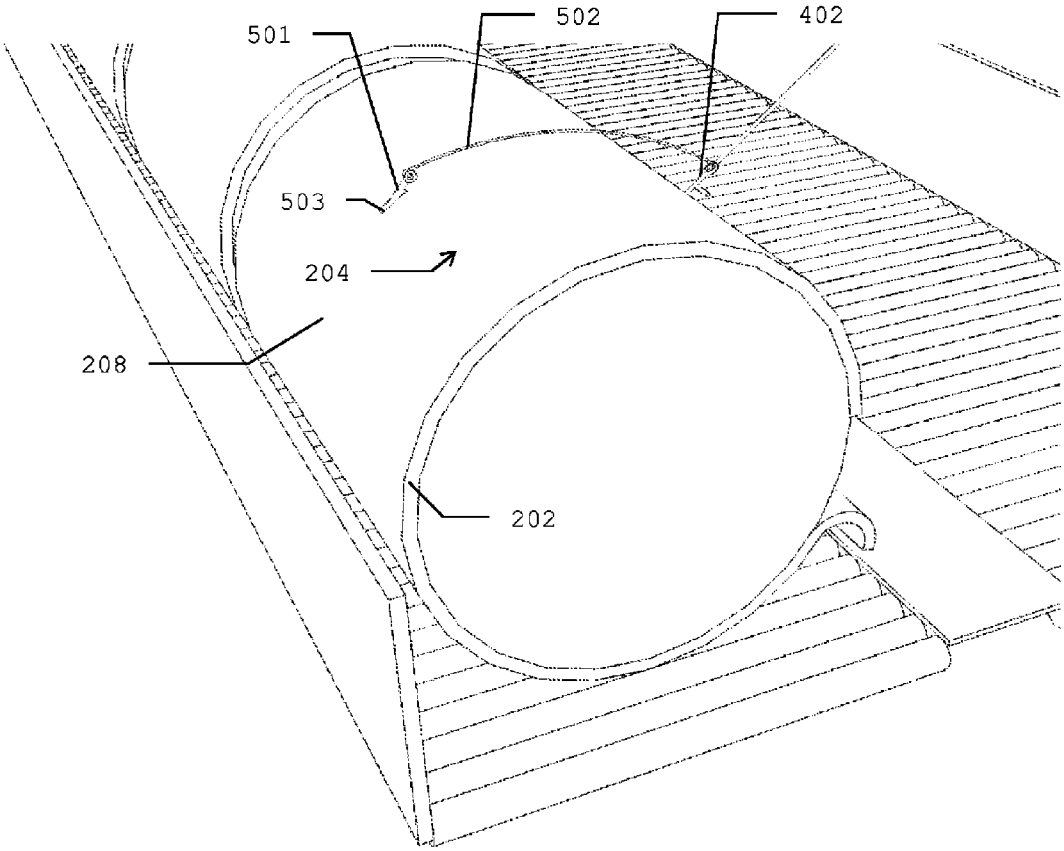
FIG. 5 illustrates a top view of round module with first module hook attached to a second module hook by a second line.

FIG. 5 illustrates a top view of round module 201 with first module hook 402 attached to a second module hook 501 by a second line 502. The second line 502 can comprise an elastic or non-elastic cable. Further, the second line 502 can be a cable, chain, rope, wire, cord, or any equivalent thereof. A second module hook cut 503 can be created by scoring round module sidewall 204 substantially in the upper central surface of round module back 208 with the cutter 407. Second module hook 501 can be inserted into second module hook cut 503.

Figure 6:
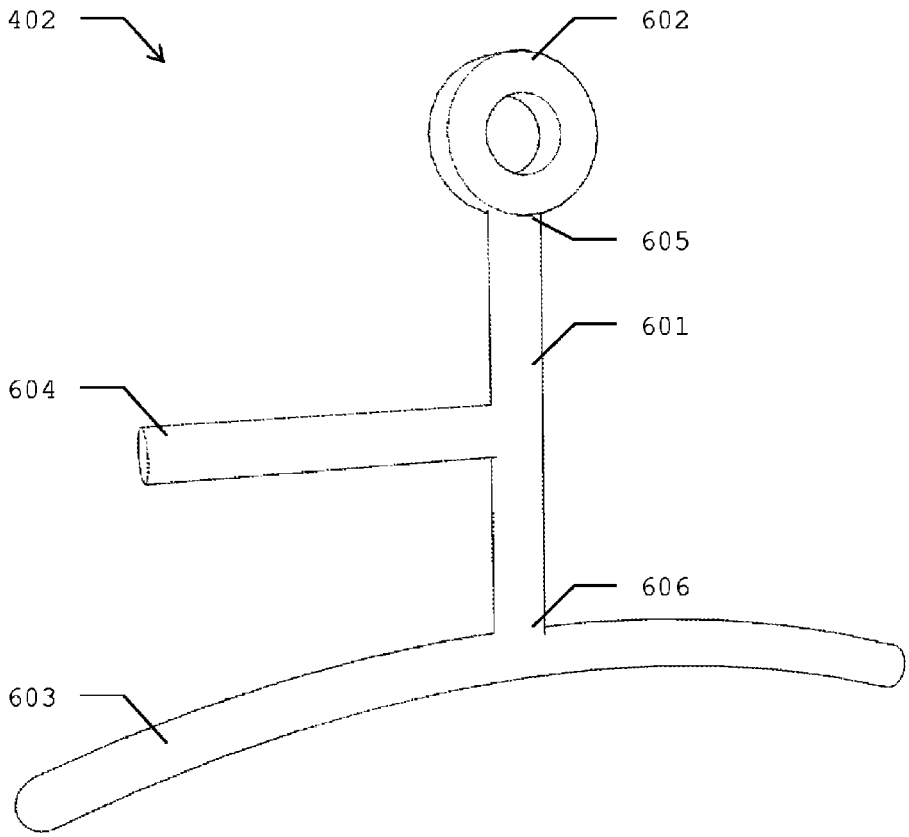
FIG. 6 illustrates first module hook.

FIG. 6 illustrates first module hook 402. In one embodiment, first module hook 402 can be substantially in the form of a t-handle. First module hook 402 can comprise a first module hook shaft 601, a first module hook tie off 602, a first module hook insertion 603, and a first module hook arm 604. First module hook shaft 601 can comprise a first module hook shaft first end 605 and a first module hook shaft second end 606. First module hook tie off 602 can comprise a ring that fastens lines to first module hook 402. First module hook insertion 603 can comprise a curved shaft with rounded ends. In one embodiment, first module hook 402 can comprise first module hook tie off 602 attached to first module hook shaft first end 605, first module hook insertion 603 attached to first module hook shaft second end 606, and first module hook arm 604 attached to a midpoint of first module hook shaft 601.

Figure 7:
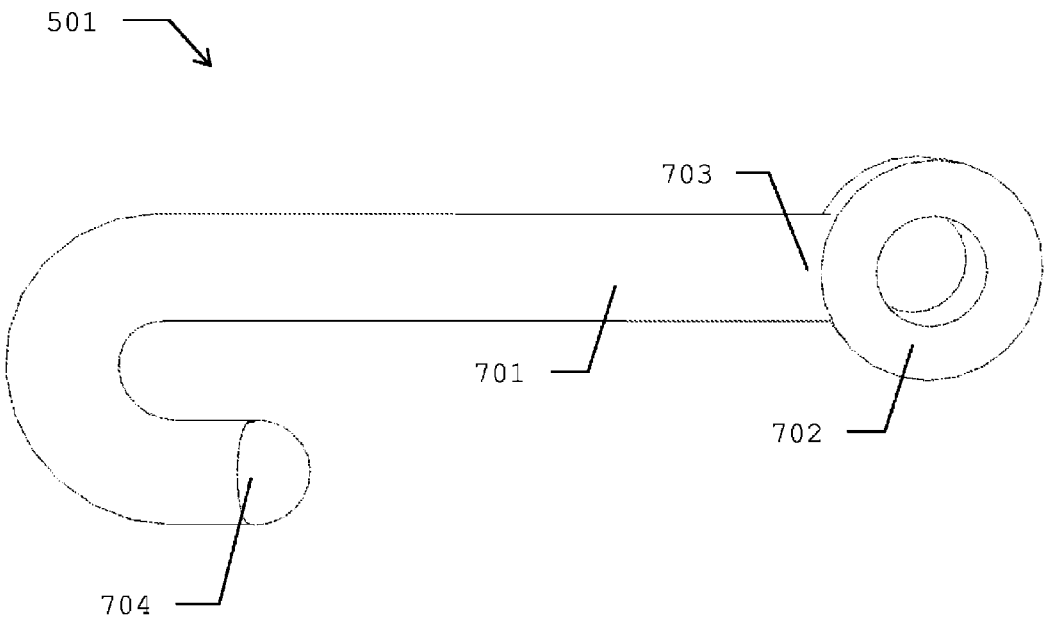
FIG. 7 illustrates a second module hook.

FIG. 7 illustrates a second module hook 501. Second module hook 501 can comprise a second module hook shaft 701 and a second module hook tie off 702. Second module hook shaft 701 can comprise a second module hook first end 703 and a second module hook second end 704. Second module hook tie off 702 can comprise a ring that fastens cables to module hook 501. In one embodiment, second module hook tie off 702 can be attached to second module hook first end 703, second module hook shaft 701 can be hook shaped, and second module hook second end 704 can be rounded.

Figure 8:
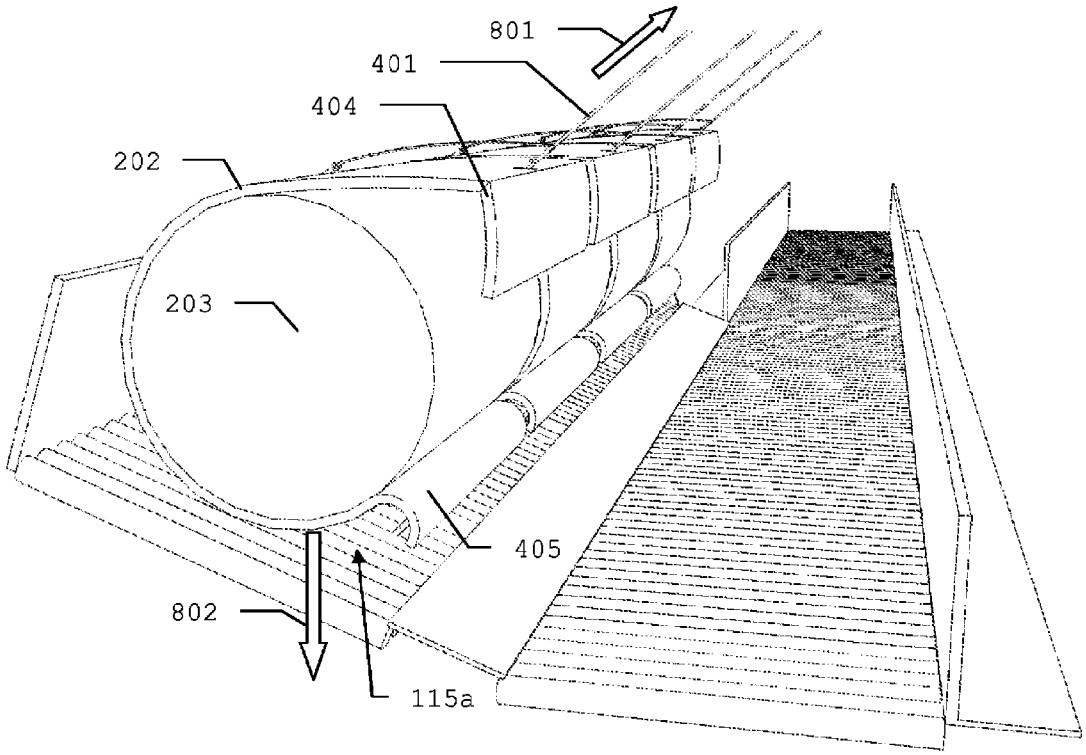
FIG. 8 illustrates a titling module feeder inclined with module wrapper top flap pulled away from round module exposing packed fibrous material.

FIG. 8 illustrates a titling module feeder 102 inclined with module wrapper top flap 404 pulled away from round module 201 exposing packed fibrous material 203. Module wrapper top flap 404 can be pulled away from packed fibrous material 203 by an outward line force 801 acting on line 401. Outward line force 801 can be substantially outward and perpendicular to module wrapper 202. Outward line force 801 can be applied by pulling line 401 with a tension clutch, a pulley and counterweight, or the equivalent thereof. Where tilting module feeder 102 is aligned to the left of primary module feeder 101, titling module feeder 102 can be inclined by elevating tilting module feeder first side 108. In this state, round module 201 is cradled between module paddle 105 on one side and tilting module feeder floor 115*a* on the other side. Further, packed fibrous material 203 remains substantially intact due to the tension in module wrapper 202 created by outward line force 801 holding module wrapper top flap 404 and a gravitational force 802 causing module wrapper bottom flap 405 to be pinned against module feeder floor 115*a* and module feeder paddle 105.

Figure 9:
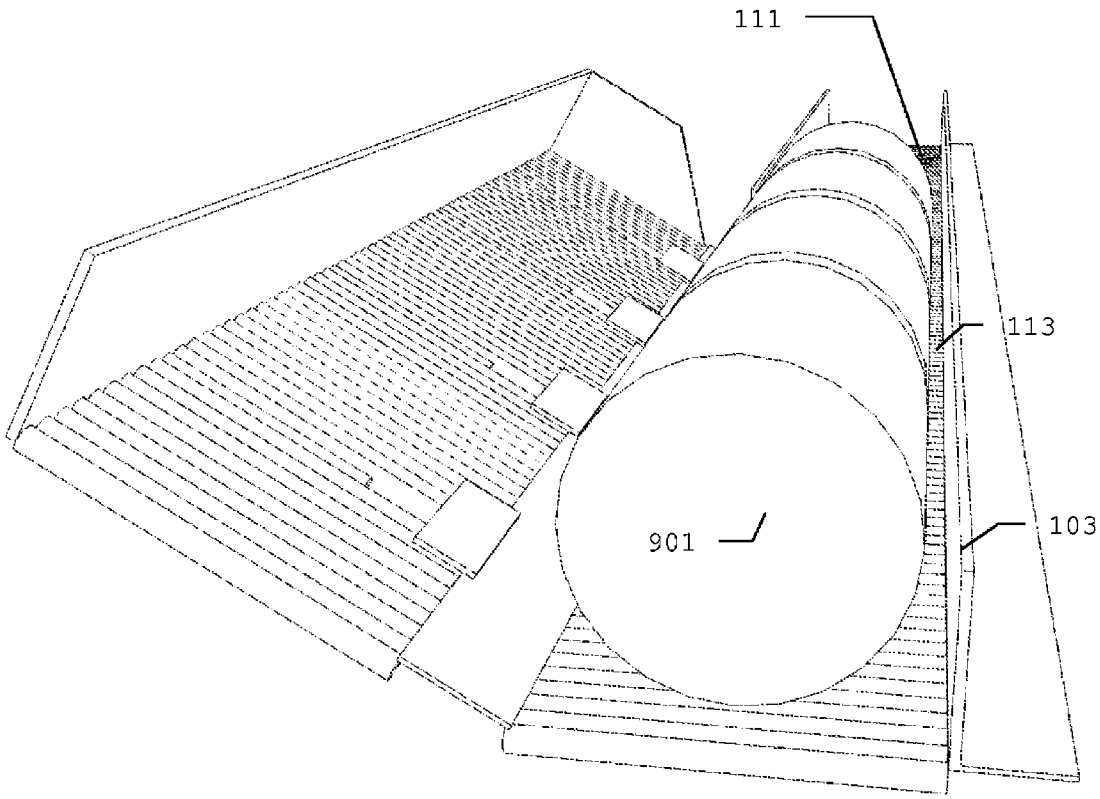
FIG. 9 illustrates a plurality of unwrapped modules on the primary module feeder.

FIG. 9 illustrates a plurality of unwrapped modules 901 on the primary module feeder 101.

Where module paddles 105 are pivoted up, module flap cut 406 has been made, first module hook 402 is inserted into module wrapper top flap 404, outward line force 801 has been applied to first module hook 402, and tilting module feeder 102 is inclined, round modules 201 can be unwrapped by pivoting module paddles 105 down to be substantially flat with module feeder floor 115*a*. As round module 201 transitions from tilting module feeder 102 to primary module feeder 101, outward line force 801 can pull module wrapper 202 up and away from packed fibrous material 203 inside of round module 201. In one embodiment, packed fibrous material 203 can be prevented from rolling off of primary module feeder 101 by the wind board 103 on primary module feeder second side 113.

Once transitioned to primary module feeder 101, packed fibrous material 203 is substantially unwrapped from round module 201, and is now an unwrapped module 901. Once unwrapped, module wrapper 202 is pulled away from unwrapped module 901 by outward line force 801. Unwrapped module 901 can be conveyed by primary module feeder 101 toward primary module feeder second end 111 for processing. Round module unwrapping system 100 can now be reset by lowering tilting module feeder 102 from its inclined position to its original position substantially parallel with primary module feeder 101.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A round module unwrapping system comprising, one or more module feeder floors capable of supporting a one or more round modules each having a module wrapper enclosing a packed fibrous material;

said one or more module feeder floors comprises a conveyor capable of moving said one or more round modules between a first end and a second end of said round module unwrapping system;

said one or more module feeder floors comprising a tilting module feeder having a tilting module feeder first side and a tilting module feeder second side, wherein the tilting module feeder supports one or more round modules each having a module wrapper;

said tilting module feeder comprises a non-inclined position and an inclined position;

said non-inclined position comprises said one or more tilting module feeders substantially horizontal;

said inclined position comprises a first side of said one or more tilting module feeders raised higher than a second side of said one or more tilting module feeders;

said round module unwrapping system having a first side of said round module unwrapping system and a second side of said round module unwrapping system;

a pulling force that applies tension to a module wrapper top flap;

a cutter scores a first module hook cut into a module wrapper top flap;

a first module hook comprising a first module hook first end that connects to a line, and a first module hook second end that inserts into the first module hook cut; and said pulling force comprises pulling said first module hook first end with said line.

2. The round module unwrapping system of claim 1 further comprising:

said cutter that cuts the module wrapper substantially horizontally from a round module first side to a round module second side.

3. The round module unwrapping system of claim 1 wherein the cutter scores a second module hook cut into the module wrapper substantially in the upper central surface of a round module back.

4. The round module unwrapping system of claim 3 further comprising a second module hook comprising a second module hook first end; and a second module hook second end that inserts into the second module hook cut; and a second line having a second line first end and a second line second end, where in the second line first end connects to the first module hook first end, and the second line second end connects to the second module hook first end.

5. The round module unwrapping system of claim 1 wherein the first hook is substantially in the form of a t-handle.

6. The round module unwrapping system of claim 1 further comprising a module paddle that pivots upward to buttress the round module and pivots downward to release the round module.

7. The round module unwrapping system of claim 1 further comprising said one or more module feeder floors comprising a primary module feeder having a primary module feeder first side and a primary module feeder second side wherein the tilting module feeder is aligned along the primary module feeder first side.

8. The round module unwrapping system of claim 7 further comprising a second tilting module feeder aligned along the primary module feeder second side.

9. The round module unwrapping system of claim 7 further comprising an intermediate module unwrapper catwalk aligned between the tilting module feeder second side and the primary module feeder first side.

10. The round module unwrapping system of claim 7 further comprising a wind board on a primary module feeder second side.

11. The round module unwrapping system of claim 7 wherein, said second side of said one or more tilting module feeders is aligned next to said primary module feeder.

12. The round module unwrapping system of claim 1 wherein said line comprises a rope.

13. The round module unwrapping system of claim 1 wherein said line comprises a cable.

* * * * *